US008740354B2

(12) United States Patent
Nakao et al.

(10) Patent No.: US 8,740,354 B2
(45) Date of Patent: Jun. 3, 2014

(54) LIQUID EJECTING HEAD AND LIQUID EJECTING APPARATUS

(75) Inventors: Hajime Nakao, Suwa (JP); Keiji Hara, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 57 days.

(21) Appl. No.: 13/429,124

(22) Filed: Mar. 23, 2012

(65) Prior Publication Data

US 2012/0242753 A1 Sep. 27, 2012

(30) Foreign Application Priority Data

Mar. 24, 2011 (JP) ..... 2011-066811

(51) Int. Cl.
*B41J 2/05* (2006.01)

(52) U.S. Cl.
USPC ..... 347/65

(58) Field of Classification Search
USPC ..... 347/65
See application file for complete search history.

(56) References Cited

U.S. PATENT DOCUMENTS 6,634,742 B2 10/2003 Owaki et al.
2010/0201760 A1 8/2010 Kanaya

FOREIGN PATENT DOCUMENTS

JP 2002-178541 A 6/2002
JP 2005-096442 A 4/2005
JP 2008221694 A * 9/2008
JP 2010-184426 A 8/2010

* cited by examiner

*Primary Examiner* — Lisa M Solomon
(74) *Attorney, Agent, or Firm* — Kilpatrick Townsend & Stockton LLP

(57) ABSTRACT

A first member and a second member constituting flow passage member are joined at a first joining region that surrounds the periphery of a liquid flow passage and a second joining region that is further to the outside than the first joining region, and in a state where the second joining region has a gas barrier property higher than that of the first joining region, the second joining region seals a gap between the first member and the second member, wherein the liquid ejecting head includes a communication hole that communicates a space between the first member and the second member with the outside, which is surrounded by the first joining region and the second joining region.

10 Claims, 4 Drawing Sheets

LIQUID EJECTING HEAD AND LIQUID EJECTING APPARATUS

BACKGROUND

1. Technical Field

The present invention relates to a liquid ejecting head and a liquid ejecting apparatus which ejects the liquid, and specifically to an ink jet type recording head and an ink jet type recording apparatus which ejects ink.

2. Related Art

In an ink jet type recording head that is a representative example of a liquid ejecting head, generally, the ink is supplied from a storage unit such as an ink cartridge where the ink is filled to a head main body, and a pressure generation unit such as a piezoelectric element or a heating element is driven so that the ink supplied to the head main body is ejected from nozzles.

The above-described ink jet type recording head includes a flow passage member in which a liquid flow passage connecting a storage unit and a head main body is formed. A structure of the flow passage member is suggested in various ways, and for example, a structure where a liquid flow passage is defined by a plurality of members joined with the adhesive (for example, JP-A-2002-178541).

As an adhesive joining a plurality of members configuring the flow passage member, it is preferable to use an adhesive having high bonding strength. However, even though the adhesive has high bonding strength, if gas permeability is high (if gas barrier property is low), there is a concern of gas (air) penetrating from the outside into a liquid flow passage and conversely there is also a concern of the liquid (the fluid) penetrating into the liquid flow passage.

In addition, such problems are not limited to an ink jet type recording head, and are also similarly present in a liquid ejecting head ejecting a liquid other than ink.

SUMMARY

An advantage of some aspects of the invention is that it provides a liquid ejecting head and a liquid ejecting apparatus, in which leaking of the liquid may be suppressed, and the gas barrier property may be increased and reliability thereof may be improved.

According to an aspect of the invention, there is provided a liquid ejecting head includes a head main body that has nozzles ejecting liquid droplets; and a flow passage member in which a liquid flow passage is formed, the liquid flow passage connecting a storage unit storing the liquid and the head main body. The flow passage member includes a first member that configures a portion of a wall surface of the liquid flow passage, and a second member that configures a portion of a wall surface different from the first member of the liquid flow passage. The first member and the second member are joined at a first joining region that surrounds the periphery of the liquid flow passage and a second joining region that is further to the outside than the first joining region, and in a state where the second joining region has a gas barrier property higher than that of the first joining region, a gap between the first member and the second member is sealed. The liquid ejecting head further includes a communication hole that communicates a space between the first member and the second member with the outside, the first member and the second member being surrounded by the first joining region and the second joining region.

According to the invention, the first member and the second member are firmly bonded and the penetration of the gas (air) inside the space section into the liquid flow passage is suppressed.

It is preferable that the communication hole be provided as meandering. Even though the liquid (the fluid) inside the liquid flow passage leaks to the space section, the fluid can be suppressed from being discharged to the outside via the communication hole. In other words, an increase in the viscosity of the liquid inside the liquid flow passage can be suppressed.

It is preferable that the first joining region be joined by the adhesive and the second joining region be joined by the welding. Accordingly, the first member and the second member are more firmly fixed.

It is preferable that the first member and the second member be accommodated in a state where one side thereof is inserted into the other side. Accordingly, the first member and the second member are more firmly fixed, and the liquid flow passage is formed without leakage.

It is preferable that the first joining region be provided at a convex section where at least one of the first member and the second member projects to the other side. Accordingly, the periphery of the liquid flow passage can be more firmly sealed.

According to another aspect of the invention, there is provided a liquid ejecting apparatus including the liquid ejecting head according to any one of above-described configurations. According to the aspect of the invention, the liquid ejecting apparatus with improved reliability may be realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on embodiments.

First Embodiment

Figure 1:
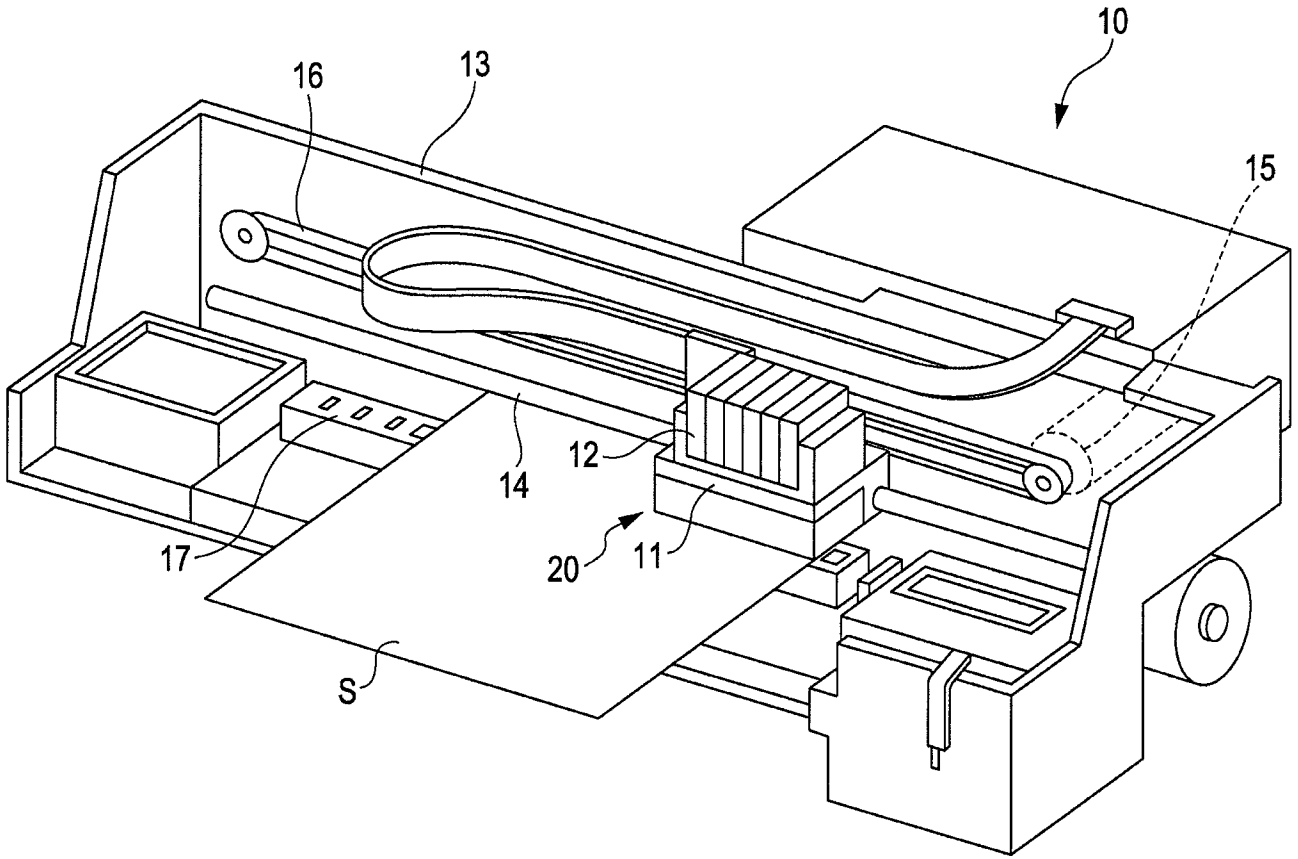
FIG. 1 is a perspective view schematically illustrating a recording apparatus according to a first embodiment of the invention.

First of all, a schematic configuration of an ink jet type recording apparatus (also, referred to as "a recording apparatus" below) 10 that is an example of a liquid ejecting apparatus of the invention will be described. As shown in FIG. 1, the recording apparatus 10 includes an inkjet type recording head (also, referred to as "a recording head" below) 20 that is an example of a liquid ejecting head ejecting liquid droplets. The recording head 20 is installed on a carriage 11 and a plurality of ink cartridges 12 that is a storage unit in which the ink is stored is detachably fixed to the recording head 20.

The carriage 11 is provided movably in the axial direction at a carriage shaft 14 attached to an apparatus main body 13.

The driving force of a driving motor 15 is transmitted via a plurality of gears (not shown) and a timing belt 16 so that the carriage 11 is allowed to move along the carriage shaft 14. In addition, a platen 17 is provided in the apparatus main body 13 along the carriage shaft 14 and a recording medium S such as a paper fed by a paper feeding apparatus (not shown) is allowed to be transported on the platen 17.

Figure 2A:
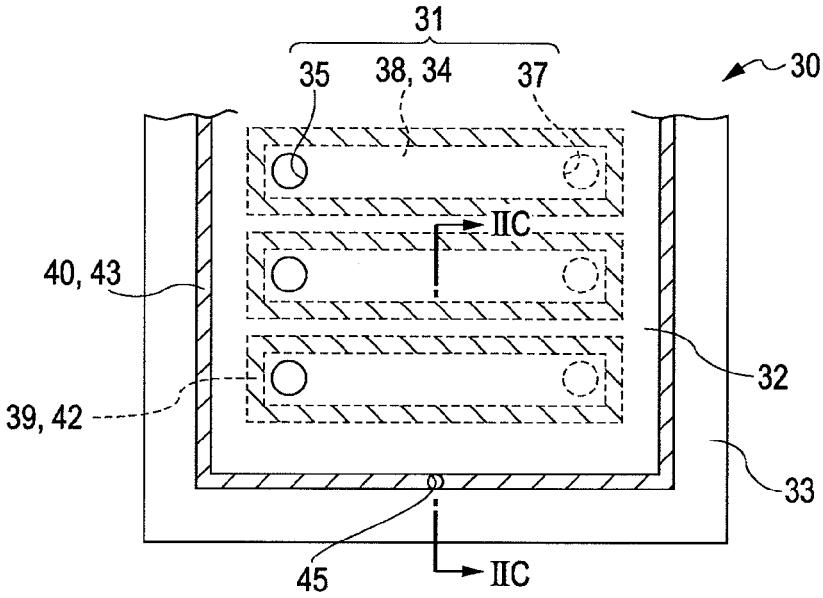
FIGS. 2A to 2C are plan and cross-sectional views illustrating a flow passage member according to a first embodiment of the invention.
Figure 2B:
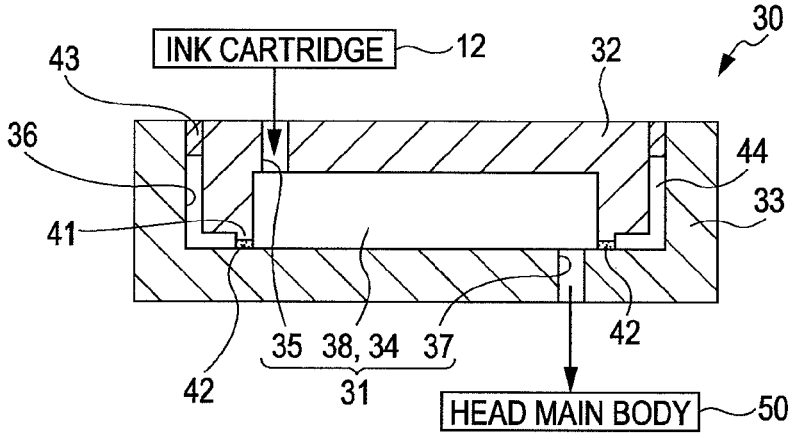
Figure 2C:
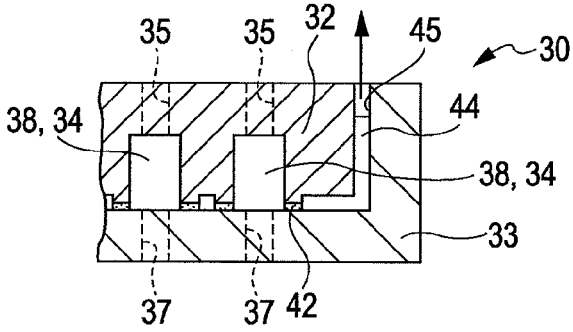

Here, a flow passage member 30 that configures the recording head 20 will be described. As shown in FIGS. 2A to 2C, the flow passage member 30 includes an ink flow passage (a liquid flow passage) 31 connecting the ink cartridge 12 and a head main body 50 described later. In other words, the ink flow passage 31 of the flow passage member 30 is configured such that one end thereof is connected to the ink cartridge 12 and the other end is connected to the head main body 50.

The flow passage member 30 is configured of a first member 32 constituting a portion of a wall surface of the ink flow passage 31 and a second member 33 constituting a portion of the wall surface, which is different from the first member 32 of the ink flow passage 31. The first member 32 and the second member 33 are joined together and then the ink flow passage 31 is defined. Specifically, a plurality of recess sections 34 corresponding to each color ink is formed at one surface side of the first member 32. In addition, a first flow passage 35 of which one end side communicates with each concave section 34 penetrates the first member 32 in the thickness direction and then is provided at the first member 32.

Meanwhile, the second member 33 includes an accommodation section 36 that can accommodate the first member 32 and has a box-shape of which one surface side is opened. In addition, a second flow passage 37 penetrating the second member 33 in the thickness direction is provided at a bottom surface of the accommodation section 36 of the second member 33.

In a state where the first member 32 is fitted within the accommodation section 36 of the second member 33 from the concave section 34 side and the first member 32 is accommodated within the accommodation section 36 of the second member 33, both are joined. As described above, the first member 32 and the second member 33 are joined in a nested state, and one side surface of the concave section 34 of the first member 32 is sealed with the second member 33 so that a third flow passage 38 is formed. In other words, the ink flow passage 31 consisting of the first flow passage 35, the second flow passage 37 and the third flow passage 38 is formed in the flow passage member 30 consisting of the first member 32 and the second member 33.

Here, the first member 32 and the second member 33 are joined at a first joining region 39 surrounding the periphery of the ink flow passage 31, and a second joining region 40 that is further to the outside than the first joining region 39. In the embodiment, the first joining region 39 is provided at the periphery of each concave section 34 (the third flow passage 38) formed at the first member 32 and the second joining region 40 is provided at the periphery of the first member 32, in other words, at an opening edge of the accommodation section 36 of the second member 33.

In the first member 32, a convex section 41 projected further to the outside than other portions is provided at the first joining region 39 in other words, at the periphery of each concave section 34 as surrounding the concave section 34. The first member 32 is joined by an adhesive layer 42 in a state where the convex section 41 is substantially in contact with the second member 33. Accordingly, the first member 32 and the second member 33 can be positioned well and the periphery of the concave section 34 is sealed well so that the third flow passage 38 can be formed. Material (type of adhesive) of the adhesive layer 42 joining the first member 32 and the second member 33 is not limited specifically; however, it is desirable that it be an adhesive having relatively high bonding strength, such as an epoxy based adhesive.

In the embodiment, the convex section is provided at the first member, however, a convex section may be provided at the second member, and the convex section may be provided at the first and the second members respectively.

Meanwhile, in the second joining region 40, the first member 32 and the second member 33 are joined in a state where the gas barrier property thereof is higher than the first joining region 39, and a gap between the first member 32 and the second member 33 is sealed. In the embodiment, the first joining region 39 is joined by the adhesive layer (the adhesive) 42 while in the second joining region 40, the first member 32 and the second member 33 are for example, welded and joined for example, by the heat or ultrasonic waves. A welding layer 43 is formed between the first member 32 and the second member 33. Accordingly, the second joining region 40 becomes a state where the gas barrier property thereof is reliably higher than the first joining region 39.

However, in the configuration where the first member 32 and the second member 33 are joined at the first joining region 39 and the second joining region 40, a space 44 surrounded by the first joining region 39 and the second joining region 40 between the first member 32 and the second member 33 will be inevitably formed. In the invention, a communication hole 45 that is a fine hole through which the space 44 communicates with outside is provided at the flow passage member 30. In other words, the space 44 is allowed to open to the atmosphere by the communication hole 45.

Accordingly, for example, even if the gas (air) inside the space 44 is expanded according to increase of the environmental temperature, the gas inside the space 44 is discharged to the outside via communication hole 45. Accordingly, infiltration of the gas (air) into the ink flow passage 31 from the adhesive layer 42 is suppressed and occurrence of problems such as dot missings can be suppressed.

Such a communication hole 45 may be formed at any position at the flow passage member 30, however, in the embodiment, it is provided at a welding layer 43 of the second joining region 40. In addition, when the size or the number of communication holes 45 is also not specifically limited. However, when the communication hole 45 is formed too large or in large numbers, the gas barrier property of the welding layer 43 may be greatly decreased. Accordingly, it is desirable that the communication hole 45 be formed as small as possible to the extent that the gas inside the space 44 is reliably discharged to the outside.

Figure 3:
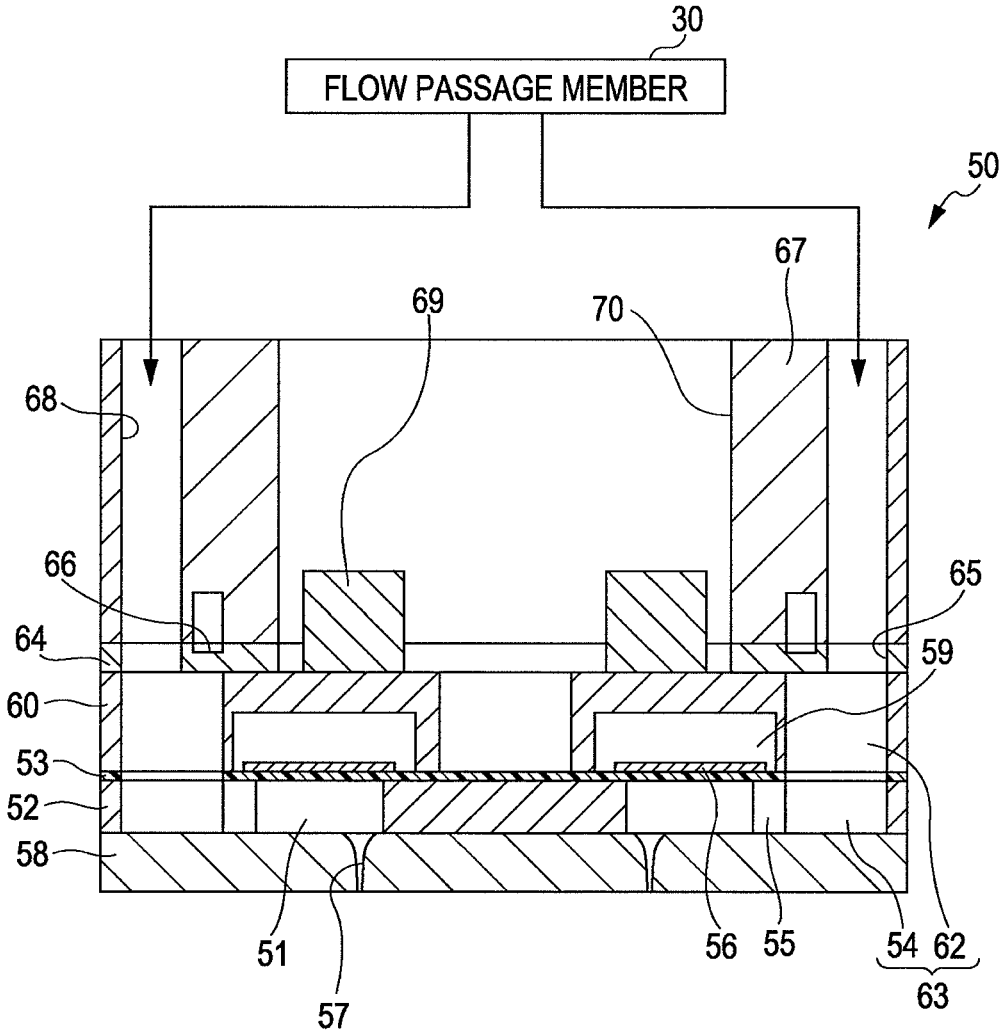
FIG. 3 is a cross-sectional view illustrating a head main body according to a first embodiment of the invention.

Next, an example of the head main body 50 that configures of the recording head 20 with the flow passage member 30 will be described. As shown in FIG. 3, the head main body 50 includes a flow passage forming substrate 52 where a plurality of pressure generation chambers 51 is formed. In the embodiment, in the flow passage forming substrate 52, columns of the pressure generation chamber 51 provided in parallel in the width dimension are formed in two columns. The pressure generation chamber 51 is provided as penetrating the flow passage forming substrate 52 in the thickness direction, and one surface side thereof is configured of an elastic membrane 53 formed on the flow passage forming substrate 52. In the flow passage forming substrate 52, a communication section 54 is formed at the outside of the pressure generation chamber 51 of each column in the longitudinal direction. The communication section 54 is communicated with one end portion of each pressure generation chamber 51 in the longitudinal direction respectively via a supply section 55.

On the elastic membrane 53, a piezoelectric element 56 is formed, which is for example, configured of a piezoelectric layer having a pair of electrodes and a piezoelectric material provided between the pair of electrodes. Meanwhile, a nozzle plate 58 where a plurality of the nozzles 57 is formed corresponding to each pressure generation chamber 51 is joined at a surface opposite to the elastic membrane 53 of the flow passage forming substrate 52.

In addition, a protection substrate 60 including the piezoelectric element holding section 59 for protecting the piezoelectric element 56 is joined at a surface of the piezoelectric element 56 side of the flow passage forming substrate 52. In addition, in the protection substrate 60, a manifold section 62 is provided at a position facing the communication section 54. The manifold section 62 communicates with the communication section 54 and then configures a manifold 63 that is a common ink chamber of each pressure generation chamber 51.

A compliance substrate 64 is joined on the protection substrate 60. An ink inlet 65 for supplying ink to the manifold 63 is provided at the compliance substrate 64 to face the manifold 63. In addition, a region of the compliance substrate 64 facing the manifold 63 has a flexible section 66 of which a thickness is thinner than other portions except the portion of the ink inlet 65.

A head case 67 is fixed on the compliance substrate 64. The head case 67 is provided with an ink supply communication passage 68 that communicates with the ink inlet 65 and at the same time, communicates with above-described flow passage member 30.

In addition, a driving circuit 69 having the semiconductor integrated circuit (IC) or the like for driving each piezoelectric element 56 is provided on the protection substrate 60, a driving circuit holding section 70 which penetrates a region facing the driving circuit 69 in the thickness direction is provided at the head case 67. A driving wire (not shown) inserted into the driving circuit holding section 70 is connected to the driving circuit 69.

In each head main body 50, in a state where the inside thereof is filled with ink from the manifold 63 to the nozzle 57 via ink inlet 65, the voltage is applied to each piezoelectric element 56 corresponding to each pressure generation chamber 51 according to the recording signal from the driving circuit 69, and the piezoelectric element 56 is flexibly deformed so that the pressure inside each pressure generation chamber 51 increases and the ink droplets are ejected from the nozzle 57.

Second Embodiment

Figure 4A:
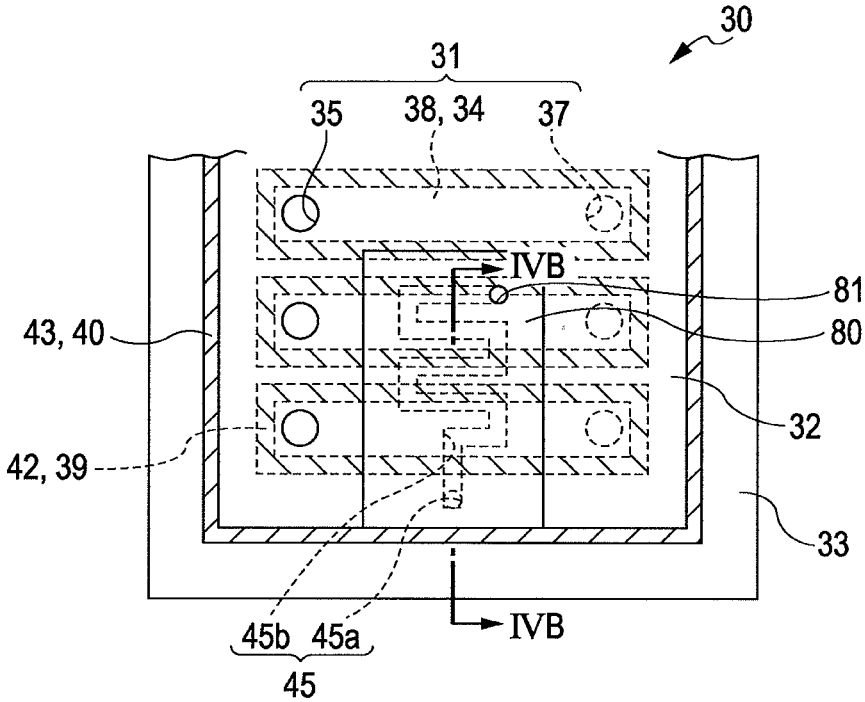
FIGS. 4A and 4B are plan and cross-sectional views illustrating a flow passage member according to a second embodiment of the invention.
Figure 4B:
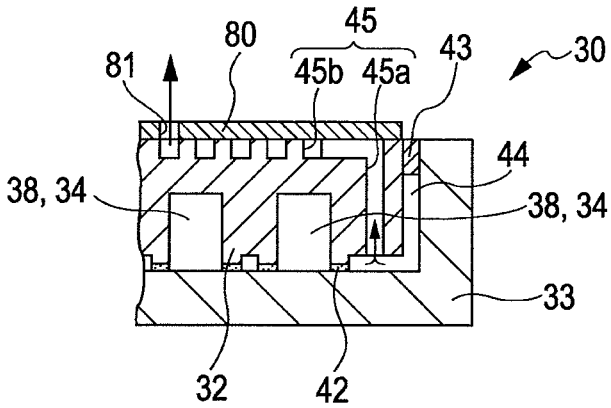

FIGS. 4A and 4B are plan and cross-sectional views illustrating a flow passage member according to a second embodiment.

The embodiment is a modified example of the communication hole and other configurations are similar to the first embodiment. Hereinafter, the same reference numerals are applied to the same members and the redundant description thereof is omitted.

As shown in FIGS. 4A and 4B, the communication hole 45 according to the embodiment includes a penetration hole 45*a* penetrating in the first member 32 in the thickness direction and leading to the space 44, and a groove section 45*b* provided at the surface of the first member 32. One end of the recess section 45*b* is connected to the penetration hole 45*a* and the recess section 45*b* is provided at the surface opposite to the second member 33 of the first member 32 as meandering. One surface side of the recess section 45*b* is covered by a sealing film 80 consisting of a film having the gas barrier property. The sealing film 80 is configured of for example, a polypropylene or polyethylene film and a silica film or aluminum film, and is joined to the first member 32 by welding using heat or ultrasonic wave. An opening section 81 is formed at the sealing film 80 and the other end of the recess section 45*b* communicates with the opening section 81.

In other words, in the embodiment, the space 44 formed between the first member 32 and the second member 33 is open to the atmosphere via communication hole 45 configured of the penetration hole 45*a*, the recess section 45*b* and the opening section 81.

Of course, even in such a configuration, similar to the case of the first embodiment, the first member 32 and the second member 33 can be excellently joined. In addition, since the gas inside the space 44 is discharged to the outside via communication hole 45, the infiltration of the gas (air) from the adhesive layer 42 into the ink flow passage 31 is suppressed and the occurrence of problems such as dot missings can be suppressed.

Specifically, in the embodiment, the recess section 45*b* configuring the communication hole 45 is formed as meandering, the entire length of the communication hole 45 becomes relatively long, and the opening surface of the recess section 45*b* is sealed by the sealing film 80. Accordingly, even though fluid inside the ink flow passage 31 is leaked into the space 44 via adhesive layer 42, an amount of the fluid that is discharged from the communication hole 45 to the outside can be suppressed as much as possible. In other words, the increase of the viscosity of the ink inside the ink flow passage 31 can be suppressed.

In addition, in the embodiment, the recess section 45*b* configuring the communication hole 45 is provided at the surface of the first member 32, however, the position of the formation of the recess section 45*b* is not particularly limited. For example, the recess section 45*b* may be provided at the surface of the second member 33.

Other Embodiment

Hereinabove, one embodiment of the invention has been described; however, the basic configuration of the invention is not limited to the above description. For example, in the above-described embodiment, the first joining region 39 of the first member 32 and the second member 33 is joined by the adhesive layer 42, and the second joining region 40 is joined by the welding layer 43, however, the joining method of the first and second joining regions 39 and 40 is not limited specifically. For example, the second joining region 40 may be joined by the adhesive having high gas barrier property.

In addition, in the above-described embodiment, the example in which the concave section 34 that is the third flow passage 38 is provided at the first member 32, however, the concave section 34 may be provided at the second member 33.

In addition, in the above-described embodiment, as the recording apparatus 10, the configuration in which the ink cartridge 12 is installed on the carriage 11 is exemplified; however, the configuration of the recording apparatus 10 is not limited to the embodiment. The recording apparatus may be a type of apparatus where the storage unit such as the ink cartridge is fixed to the apparatus main body and the ink in the storage unit is supplied to each head main body via a supply tube or the like. In this case, the flow passage member may be provided along the supply tube or between the ink cartridge and the supply tube.

In addition, as the above-described recording apparatus 10, the apparatus is illustrated where the recording head 20 is mounted on the carriage 11 and moves in the main scanning direction, however, the recording apparatus may be a so-called line type recording apparatus where for example, the recording head is fixed so that the printing is performed only by moving the medium to be recorded such as paper in sub-scanning direction.

Furthermore, the invention is intended for the entire liquid ejecting head broadly, and may be applied to for example, color material ejecting head that is used for manufacturing of a color filter such as a liquid crystal display, an organic EL display, an ejecting head of the electrode material that is used for forming electrodes such as an FED (a field emission display), a bioorganic ejecting head or the like that is used for manufacturing a biochip besides the recording head such as various ink jet type recording head that is used in the image recording apparatus such as the printer. In addition, as an example of the liquid ejecting apparatus, the ink jet type recording apparatus has been described, however, the invention can also be applied to the liquid ejecting apparatus including a liquid ejecting head other than the above-described recording apparatus.

The entire disclosure of Japanese Patent Application No. 2011-066811, filed Mar. 24, 2011 is expressly incorporated by reference herein.

What is claimed is:

1. A liquid ejecting head comprising:

a head main body that has nozzles ejecting liquid droplets; and a flow passage member in which a liquid flow passage is formed, the liquid flow passage connecting a storage unit storing the liquid and the head main body, wherein the flow passage member includes a first member that configures a portion of a wall surface of the liquid flow passage, and a second member that configures a portion of a wall surface different from the first member of the liquid flow passage, wherein the first member and the second member are joined at a first joining region that surrounds a periphery of the liquid flow passage and a second joining region that is further to an outside of the flow passage member than the first joining region, wherein the second joining region has a gas barrier property higher than that of the first joining region, wherein a space is defined between the first joining region and the second joining region, wherein the space is separate from and fluidly isolated from the liquid flow passage, wherein the space communicates with the outside through a communication hole.

2. The liquid ejecting head according to claim 1, wherein the communication hole has a meandering shape.

3. The liquid ejecting head according to claim 1, wherein the first joining region is joined by adhesive and the second joining region is joined by welding.

4. The liquid ejecting head according to claim 1, wherein the first member and the second member are accommodated in a state where one side thereof is inserted into the other side.

5. The liquid ejecting head according to claim 1, wherein the first joining region is provided at a convex section where at least one of the first member and the second member projects to the other side.

6. A liquid ejecting apparatus including the liquid ejecting head according to claim 1.

7. A liquid ejecting apparatus including the liquid ejecting head according to claim 2.

8. A liquid ejecting apparatus including the liquid ejecting head according to claim 3.

9. A liquid ejecting apparatus including the liquid ejecting head according to claim 4.

10. A liquid ejecting apparatus including the liquid ejecting head according to claim 5.

* * * * *